United States Patent [19]

Hill et al.

[11] Patent Number: 4,515,293

[45] Date of Patent: May 7, 1985

[54] DISPENSER FOR COLLAPSIBLE CONTAINERS WITH HYDRAULIC ACTUATION

[76] Inventors: Henry R. Hill; Christine R. Hill, both of 72 Homer Rd., Solihull, West Midlands B91 3QH, England

[21] Appl. No.: 464,502

[22] PCT Filed: May 28, 1982

[86] PCT No.: PCT/GB82/00154

§ 371 Date: Jan. 26, 1983

§ 102(e) Date: Jan. 26, 1983

[87] PCT Pub. No.: WO82/04238

PCT Pub. Date: Dec. 9, 1982

[30] Foreign Application Priority Data

May 30, 1981 [GB] United Kingdom ..... 8116595

[51] Int. Cl.[3] ..... B65D 37/00

[52] U.S. Cl. ..... 222/95; 222/105; 222/181; 222/395

[58] Field of Search ..... 222/95, 96, 105, 395, 222/401, 386.5, 389, 397

[56] References Cited

U.S. PATENT DOCUMENTS 2,755,967 7/1956 Anderson et al. ..... 222/96

3,018,022 1/1962 Jones ..... 222/401

*Primary Examiner*—H. Grant Skaggs

*Assistant Examiner*—Andrew Jones

*Attorney, Agent, or Firm*—Owen, Wickersham & Erickson

[57] ABSTRACT

A dispenser for dispensing predetermined amounts of toothpaste or other material from a collapsible tube operates by subjecting the tube to hydraulic pressure thereby to squeeze the tube. The dispenser comprises a housing (10) having a first chamber (11) to hold the tube, a removable cap (18) formed with an opening from which the nozzle of the tube projects, a second chamber (12) to hold a reservoir of liquid and a slidable cap (31) movable by a spring (35) to cause a piston (30) to draw liquid from the reservoir into a pump chamber (40) through a one-way valve (28) and movable manually to cause the piston to force liquid from the pump chamber through a one-way valve (27) into the first chamber which is already filled with liquid, thereby to squeeze the tube.

14 Claims, 1 Drawing Figure

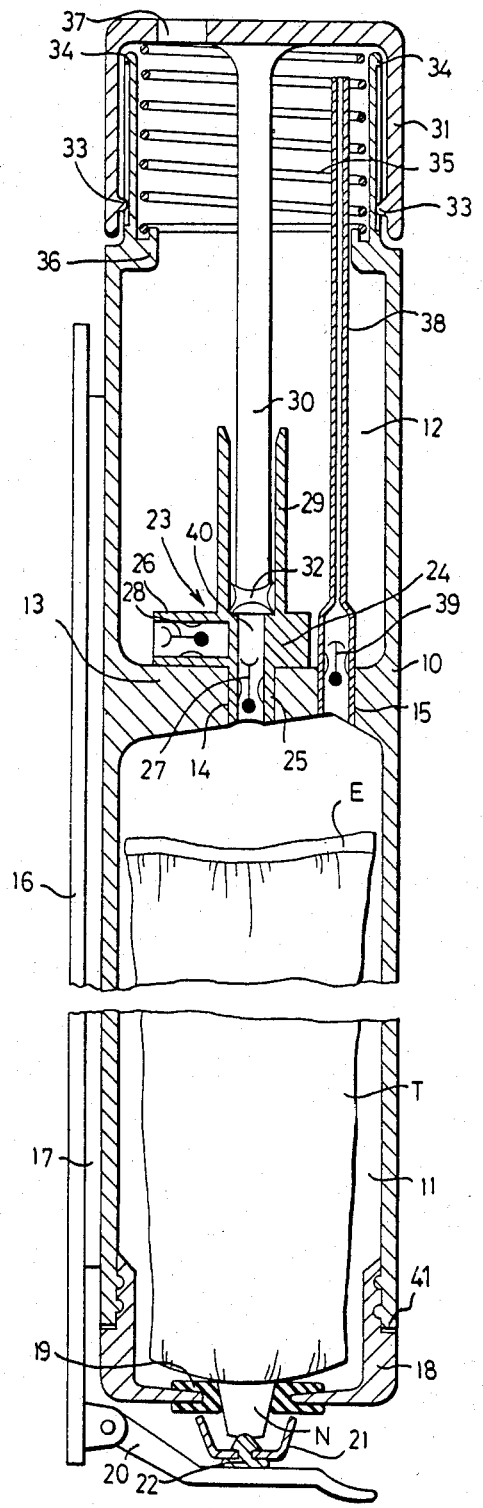
37
34
34
31
35
33
33
36
38
30
12
29
23
40
26
32
24
28
39
13
10
15
27
14
25
E
16
T
17
11
41
19
18
N
21
20
22

DISPENSER FOR COLLAPSIBLE CONTAINERS WITH HYDRAULIC ACTUATION

DESCRIPTION OF INVENTION

This invention relates to a dispenser for dispensing predetermined amounts of a liquid or a soft extrudable material.

In particular, the invention is concerned with a dispenser of the kind, hereinafter referred to as the kind specified, which is adapted to hold a collapsible or deformable container which contains a liquid or a soft extrudable material and has a nozzle through which material can be discharged by squeezing the container, the dispenser being operable to squeeze the container to dispense predetermined amounts of liquid or material.

The dispenser of the invention has been devised for dispensing toothpaste from a container in the form of a collapsible tube which is closed at one end and has a discharge nozzle at its other end, and the following description will therefore be confined to this application of the invention. However, it is to be understood that there is no limitation in this regard since the dispenser may be used to dispense other soft extrudable materials such, for example, as grease, sealing compound and adhesive as well as liquids such, for example, as liquid soap.

According to the invention there is provided a dispenser of the kind specified which is operable to dispense a liquid or a soft extrudable material from a container held by the dispenser, by subjecting the container to hydraulic pressure thereby to squeeze the container.

The dispenser preferably comprises a housing defining a chamber to receive the container, the chamber having an opening for the discharge of liquid or material from the nozzle of the container and being connected to means operable to supply hydraulic fluid under pressure to the chamber. These means preferably comprise a reservoir of hydraulic fluid and a piston operable to force fluid from the reservoir into the chamber.

The dispenser may be designed for mounting in a fixed position, for example on a wall, or it may be hand-held.

The invention will now be described, by way of example, with reference to the accompanying drawing which is a vertical section, partly cut away, of one form of dispenser embodying the invention.

The dispenser illustrated in the drawing has been designed for dispensing predetermined amounts of toothpaste from a collapsible tube T which is closed at one end E and has a nozzle N at its other end through which toothpaste can be discharged by squeezing the tube. The nozzle is screw-threaded to receive a closure cap (not shown) which is removed before the tube is placed in the dispenser.

The dispenser comprises an elongate, cylindrical housing 10 formed to provide a chamber 11 at one end in which the tube is mounted, and a chamber 12 at the other end to contain a reservoir of water, the two chambers being separated by a partition 13 formed with two bores 14, 15.

The housing 10 is provided with a mounting plate 16 enabling the dispenser to be mounted in a vertical position, as shown in the drawing, on, for example, a wall in a bathroom, the plate being fixed to the wall by, for example, adhesive or screws. The housing 10 is provided with a longitudinally extending tongue 17 of T shape in cross-section, the limb of the tongue being connected to the housing and the cross-piece being engaged in a longitudinally extending, complementarily shaped groove formed in the mounting plate. The groove is open at its upper end to enable the lower end of the tongue to be engaged in it whereupon the tongue is slid downwardly into position, the lower end of the groove being closed to provide a stop for the lower end of the tongue. The lower end of the tongue is tapered and the lower part of the groove is similarly shaped so that the tongue becomes a tight fit in the groove when it reaches the end of its downwards movement. The mounting plate may be formed to hold a tumbler and tooth brushes.

The lower end of the housing is in the form of a screw-threaded cap 18 formed with a central opening through which the nozzle N of the tube T extends, the opening being provided with an annular seal 19 for sealing engagement with the nozzle so as to prevent water escaping from the chamber 11 through the opening.

A lever 20 is pivotally mounted on the mounting plate 16 and carries a cup 21 and a closure element 22. The lever is movable between a closed position as shown in the drawing in which the closure element 22 closes the orifice of the nozzle N and the cup 21 encloses the nozzle, and an open position in which it is clear of the nozzle so that a quantity of toothpaste can be discharged from the nozzle on to a tooth brush. The lever is held in each position by a spring or other means (not shown) and it has a finger piece at its free end enabling it to be flipped from one position to the other. In a modification the lever 20 is mounted on the housing.

The dispenser is fitted with an initially separate pump unit 23 comprising a body 24 having two cylindrical portions 25 and 26 containing one-way valves 27 and 28 respectively, and a further cylindrical portion 29 which forms a cylinder for a piston 30 formed integrally with a cap 31 mounted for vertical sliding movement on the upper end of the housing 10. The piston is provided at its lower end with a sealing element 32 in sealing engagement with the cylinder. The cap 31 is guided in its vertical movement by two or more projections 33 provided on the cap at a regular circumferential spacing, the projections being engaged in vertical grooves formed in the upper part of the housing.

The cap 31 is movable between a lower position, as shown in the drawing, and an upper position the limit of which is determined by abutment of the projections 33 with stops 34 provided at the upper ends of the grooves in the housing. The cap is urged towards its upper position by a spring 35 interposed between the top of the cap and an annular projection 36 formed inside the housing. The housing is formed at the lower ends of the grooves with shallow bayonet slots with which the projections 33 can be engaged by turning the cap 31 to lock the cap in its lower position.

The cap 31 is formed with an opening 37 to facilitate filling of the chamber 12 with water. This opening may be provided with a removable closure.

The pump unit 24 is mounted in the reservoir chamber 12 with its cylindrical portion 25 extending into the bore 14. The lower end of a vent pipe 38 the upper end of which communicates with the interior of the chamber, extends into the bore 15 and contains a one-way valve 39. The portion 25, the pipe 38 and the bores 14, 15 may be screw threaded or the portion and the pipe may be a friction fit in their respective bores.

The dispenser is arranged to operate as follows.

To prepare the dispenser for use, the housing 10 is detached from the mounting plate 16 and the cap 18 is removed. The cap is fitted to the tube by screwing the nozzle of the tube into the seal 19 until the shoulder around the nozzle abuts the seal. If necessary a plug may be inserted into the nozzle to prevent toothpaste escaping from the tube during fitting of the tube. The tube is then inserted into the chamber 11 and the cap is screwed tightly onto the housing 10, clamping a sealing ring 41 between the cap and the housing. The screw thread of the cap is a multi-start thread which affords strength and requires only minimum turning of the cap so that the cap can be easily removed and refitted. The external circumferential surface of the cap is knurled or ribbed to facilitate turning of the cap. The housing 10 is then secured to the mounting plate 16 and the lever 20 is moved to its closed position.

The cap 31 is locked in its lower position and the chamber 12 is then filled with water through the opening 37 to a level just beneath the upper end of the pipe 38. During filling, water flows into the chamber 11 via valves 28 and 27 and air is vented from the chamber through the valve 39 and the pipe 38. A small quantity of water also flows into a pump chamber 40 of a predetermined volume provided in the pump unit 23.

The top of the chamber 11 is domed with its highest point at the bore 15 to ensure that all the air is expelled from the chamber and no air bubbles are formed which could affect the hydraulic pressure.

When the user requires to dispense a predetermined quantity of toothpaste, he or she flips the lever 20 to its open position and simply depresses the cap 31 against the action of the spring 35, the cap having previously been released from its locked lower position. The resultant downward movement of the piston 30 in its cylinder 29 in performance of one stroke forces the quantity of water in the pump chamber 40 through the valve 27 into the chamber 11. The hydraulic pressure in the chamber 11 is therefore increased and this has the effect of squeezing the tube T to cause an amount of toothpaste to be discharged from the nozzle N. The valve 39 prevents water escaping from the chamber 11 into the vent pipe 38. The hydraulic pressure in the chamber 11 acting on the tube also presses the tube into sealing engagement with the seal 19.

The cap 31 automatically returns to its upper position under the action of the spring 35 and as the piston 30 moves upwardly in performance of the other stroke, it draws more water from the reservoir 12 through the valve 28 into the pump chamber 40 ready for the next operative storke. The cap therefore operates as a manually operable plunger. The valve 27 prevents water being drawn from the chamber 11.

It has been found that successive operations of the dispenser result in the tube T being collapsed gradually in a direction from its closed end E towards the nozzle N. One advantage of the invention is that the total amount of toothpaste extruded from the tube by the dispenser is greater than the amount which would usually be extruded if the tube were simply squeezed by hand, and in tests it has been found that only a small amount of toothpaste remains in the nozzle. As compared with this conventional way in which a tube of toothpaste is used, there is a saving of time in that it is not necessary to pick up the tube, remove its screw cap, squeeze the tube and then replace the cap whenever toothpaste is required. The dispenser also avoids the annoyance caused by a tube of toothpaste leaking or its cap being left off, resulting in a mess in the wash-hand basin. The dispenser is hygenic and economical since it may be designed to hold a large tube of toothpaste. The novelty of using the dispenser will encourage children to clean their teeth.

The dispenser is of a simple and inexpensive design. Its component parts may be moulded of a suitable plastics material.

Of particular importance to the suppliers of toothpaste is that the dispenser can be used with tubes made of plastics materials instead of metal tubes as are usually provided, plastics tubes being cheaper than metal tubes.

What is claimed is:

1. A dispenser having a housing adapted to hold a deformable container which contains an extrudable material and has a nozzle through which said material can be discharged by squeezing the container, the dispenser being operable to squeeze the container to discharge a predetermined amount of material wherein the housing is elongate and has a longitudinal axis and defines first and second chambers which are disposed longitudinally adjacent to each other and are separated by adjacent end walls, the first chamber being arranged to receive the container and having an opening at the end thereof distant from the second chamber for discharge of the material from the nozzle of the container, the second chamber providing a reservoir for hydraulic fluid and there being a pump, comprising a piston slidable in a pump chamber, disposed in the housing and operable to pump hydraulic fluid from the second chamber into the first chamber, the pump being operable by a plunger slidably mounted on the housing, at the end thereof distant from the first chamber, for movement parallel to the longitudinal axis of the housing.

2. A dispenser as claimed in claim 1 wherein the pump is disposed within the housing adjacent to the adjacent end walls of the first and second chambers.

3. A dispenser as claimed in claim 2 wherein the pump is substantially disposed within the second chamber at the end thereof adjacent to the first chamber.

4. A dispenser as claimed in claim 1 wherein the piston is arranged on one stroke to draw fluid from the second chamber into the pump chamber which is of a predetermined volume and on the other stroke to force liquid from this pump chamber into the first chamber.

5. A dispenser as claimed in claim 4 wherein the pump chamber communicates with the first and second chambers through two one-way valves which respectively prevent fluid being drawn from the first chamber during said one stroke of the piston and prevent fluid being forced into the second chamber during said other stroke.

6. A dispenser as claimed in claim 4 wherein the piston is connected to the plunger, the plunger being movable manually to cause the piston to perform its said other stroke and being movable by spring means to cause the piston to perform its said one stroke.

7. A dispenser as claimed in claim 6 wherein the plunger is in the form of a cap having projections engaged in grooves in the housing to guide the cap for sliding movement relative to the housing, means being provided to secure the cap in a position corresponding to the end of its said second stroke.

8. A dispenser as claimed in claim 1 wherein the first chamber is provided with a vent for the expulsion of air from the chamber during filling of the latter with hydraulic fluid.

9. A dispenser as claimed in claim 1 wherein the opening of the chamber to receive the container is provided with a seal for sealing engagement with a nozzle of the container.

10. A dispenser as claimed in claim 1 which is provided with a closure element movable between a position in which it closes the nozzle of the container and a position in which it is clear of the nozzle to permit liquid or material to be discharged from the nozzle.

11. A dispenser as claimed in claim 1 wherein the opening of the chamber to receive the container is formed in a cap which is mounted on the housing and is removable from the latter to facilitate insertion of a container into the said chamber.

12. A dispenser as claimed in claim 8 wherein the piston is arranged on one stroke to draw fluid from the second chamber into the pump chamber which is of a predetermined volume and on the other stroke to force liquid from this pump chamber into the first chamber, the pump chamber communicating with the first and second chambers through two one-way valves and which respectively prevent fluid being drawn from the first chamber during said one stroke of the piston and prevent fluid being forced into the second chamber during said other stroke, the housing being provided with a transversely extending partition intermediate the ends of the housing to define said adjacent end walls of the first and second chambers, wherein the partition is formed with two bores one of which receives one end of a vent pipe extending into the second chamber and providing said vent for the first chamber and the other of which receives a part of a pump unit which defines the pump chamber, houses the one-way valves and is formed to provide a cylinder in which the piston is slidably mounted.

13. A dispenser as claimed in claim 1 wherein the second chamber is provided at the end thereof distant from the first chamber with an opening for the introduction of hydraulic fluid.

14. A dispenser as claimed in claim 13 wherein the opening is provided in the plunger.

* * * * *